US005320440A

United States Patent [19]

Papadopoulos

[11] Patent Number: 5,320,440

[45] Date of Patent: Jun. 14, 1994

[54] SHORING LEG

[75] Inventor: Demetrios G. Papadopoulos, Hounslow, England

[73] Assignee: SGB Holdings Limited, Surrey, England

[21] Appl. No.: 992,376

[22] Filed: Dec. 16, 1992

[30] Foreign Application Priority Data

Dec. 20, 1991 [GB] United Kingdom ..... 9127107

[51] Int. Cl.[5] ..... E02D 7/08

[52] U.S. Cl. ..... 405/282; 405/272

[58] Field of Search ..... 405/272, 274, 276, 278, 405/280, 281, 282

[56] References Cited

U.S. PATENT DOCUMENTS

| | | | |
|---|---|---|---|
| 865,080 | 9/1907 | Candee | 405/280 |
| 968,450 | 8/1910 | Conkling et al. | 405/278 |
| 1,841,647 | 1/1932 | Smith | 403/329 X |
| 2,128,428 | 8/1938 | Murray | 405/278 |
| 2,932,481 | 4/1960 | Breer et al. | 248/354.6 |
| 3,362,167 | 1/1968 | Ward | 405/282 |
| 3,470,699 | 10/1969 | Cox | 405/282 |
| 3,688,508 | 9/1972 | Taylor | 405/278 |
| 3,688,508 | 9/1972 | Taylor | 405/278 |
| 3,901,609 | 8/1975 | Gostling | 403/49 |
| 3,902,326 | 9/1975 | Laugenbach | 405/230 X |
| 4,657,442 | 4/1987 | Krings | 405/282 |
| 4,907,675 | 3/1990 | Saby | 182/178 |
| 4,986,690 | 1/1991 | Cooksey | 403/353 X |
| 5,048,875 | 9/1991 | Usui et al. | 285/319 |

FOREIGN PATENT DOCUMENTS

| | | |
|---|---|---|
| 0548541 | 12/1992 | European Pat. Off. . |
| 2633147 | 1/1978 | Fed. Rep. of Germany . |
| 3102211 | 12/1981 | Fed. Rep. of Germany . |
| 8712315 | 9/1987 | Fed. Rep. of Germany . |
| 3641349A1 | 6/1988 | Fed. Rep. of Germany . |
| 332026 | 7/1930 | United Kingdom . |
| 639129 | 6/1950 | United Kingdom . |
| 2083535 | 9/1981 | United Kingdom . |
| 2234005A | 1/1991 | United Kingdom . |
| 2234776A | 2/1991 | United Kingdom . |

OTHER PUBLICATIONS

English Summary for Enclosure B8 Based on Information Provided by Bureau Casalonga-Josse.

*Primary Examiner*—David H. Corbin
*Attorney, Agent, or Firm*—Arnold, White & Durkee

[57] ABSTRACT

A shoring leg comprises an extrusion of aluminum or the like. The leg has a plurality of axially extending slots in its exterior at substantially equi-angularly spaced positions. The wall of the leg defines a substantially circular outer periphery and a hollow interior. The wall is interrupted by slot formations at substantially equi-angularly spaced positions, each slot formation comprising a pair of inwardly directed lips defining a slot therebetween and an inwardly directed web of substantially semi-circular form extending between the points where the lips, on each side of the slot, extend from the said circular wall.

5 Claims, 2 Drawing Sheets

SHORING LEG

This application is the United States counterpart to the United Kingdom Application Serial No. 9127107.2, which was filed Dec. 20, 1991. Applicant claims the priority date of this foreign filing.

THE PRESENT INVENTION relates to a shoring leg.

It has been proposed previously to provide a shoring leg extruded from aluminium, with the leg presenting a plurality of axially extending slots at positions equi-spaced about the exterior of the leg, to enable scaffolding components such as frames, struts or the like to be connected to the shoring leg.

One example of a shoring leg of this type which has been used commercially is shown in DE-A-3641349 of Ischebeck & Co. GmbH. This prior Specification shows a leg which presents four equi-angularly spaced slots. Each slot forms the mouth of a substantially square channel. The leg is of a generally octagonal configuration when viewed in cross-section. A typical leg of this type, as produced by the Patentee has a length of 2 meters, and is able to withstand substantial compressional loads.

The leg only presents four slots, which means that components can only be connected to the leg extended in orthogonal directions. It has also been found that legs of this particular external configuration are difficult to carry.

The present invention seeks to provide an improved shoring leg.

According to this invention there is provided a shoring leg, the leg comprising an extrusion of aluminium or the like, the leg presenting a plurality of axially extending slots in its exterior at substantially equi-angularly spaced positions, the leg comprising a wall defining a substantially circular outer periphery and a hollow interior, the wall being interrupted by slot formations at substantially equi-angularly spaced positions, each slot formation comprising a pair of inwardly directed lips defining a slot therebetween, and an inwardly directed web of substantially semi-circular form extending between the points where the lips, on each side of the slot, extend from the said circular wall.

Preferably the lips define substantially co-aligned flat outer faces, the faces defining a plane which extends perpendicularly to a radius of the extrusion passing through the centre of the respective slot.

Conveniently the inner faces of the lips define a substantially planar surface which extends perpendicularly to a radius of the extrusion passing through the centre of the slot.

In one embodiment there are eight equi-angularly spaced slots and in another embodiment there are four equi-angularly spaced slots.

Figure 1:
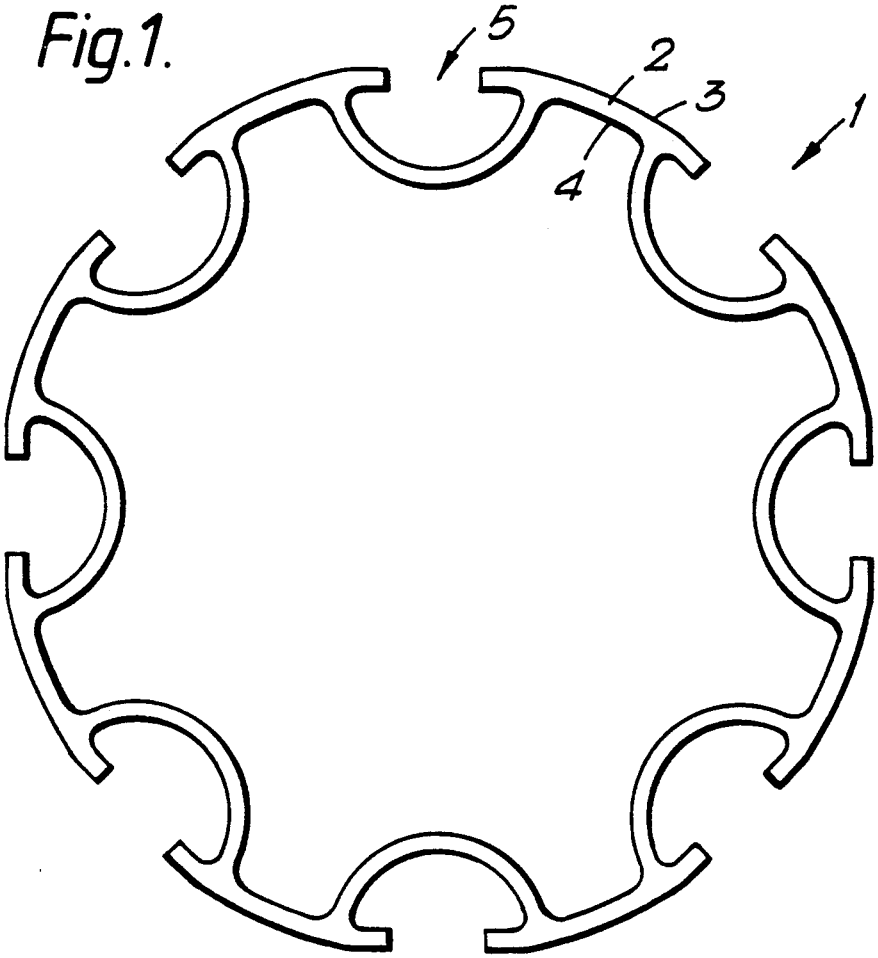
Figure 2:
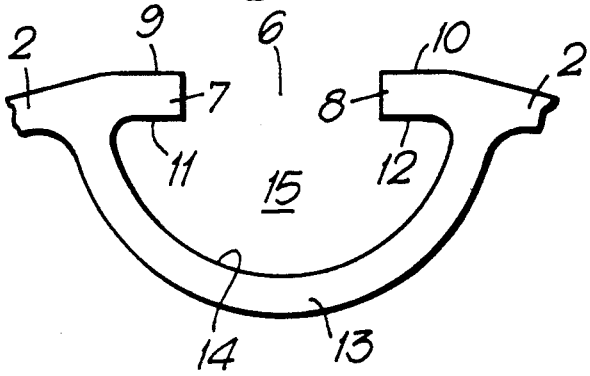
Figure 3:
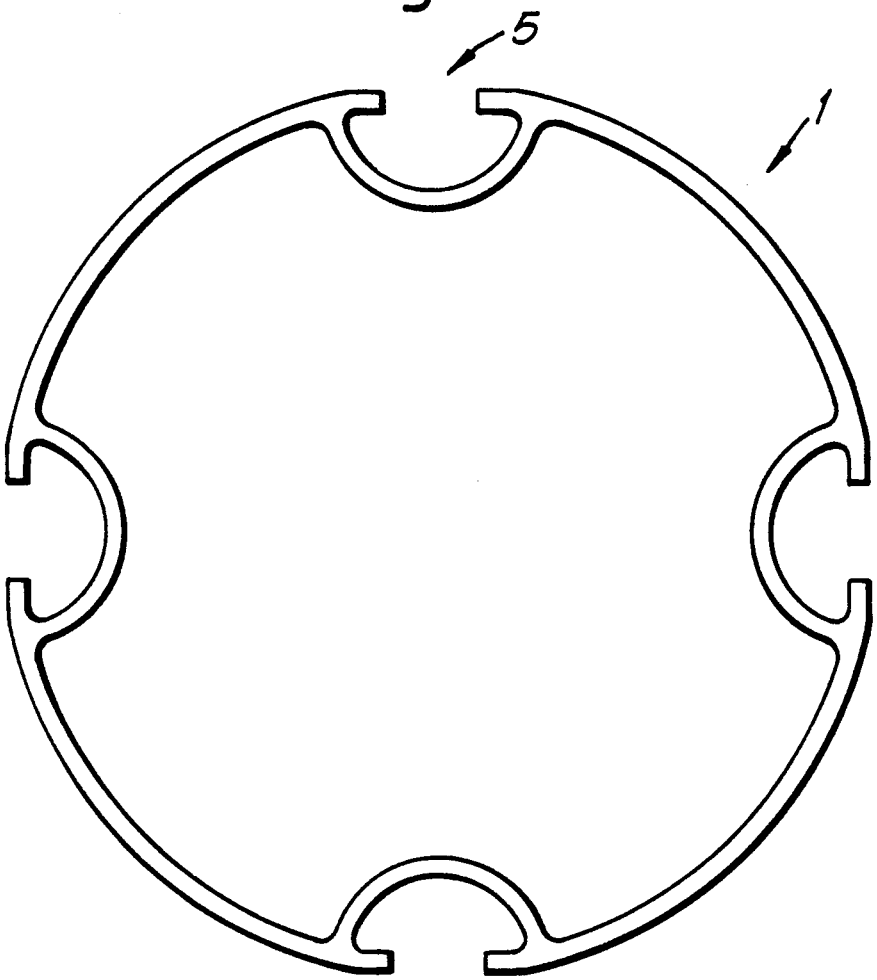

In order that the invention may be more readily understood, and so that further features thereof may be appreciated, the invention will now be described, by way of example, with reference to the accompanying drawings in which FIG. 1 is a cross-sectional view of a shoring leg in accordance with the invention, FIG. 2 is an enlarged sectional view of part of the extrusion of FIG. 1, and FIG. 3 is a cross-section of an extruded leg forming a modified embodiment of the invention.

Referring initially to FIGS. 1 and 2 of the drawings, a shoring leg is formed of an extrusion of aluminum. The extrusion comprises an outer wall 2 which has a circular outer surface 3 and a circular inner surface 4, thus defining a circular wall of uniform cross-section, the pipe being provided with a plurality of equi-angularly spaced slot formations 5.

FIG. 2 illustrates a typical slot formation 5 to an enlarged scale. In the region of each slot 5 the outer wall 2 of the extrusion is interrupted. Each slot formation 5 defines an open slot 6 which is located between two inwardly directed lips 7,8, the lips extending from the circular outer wall 2. The lips 7,8 present flat outer faces 9,10 which are co-aligned, the flat faces defining a plane which is perpendicular to the radius passing from the centre of the extrusion 1 to the centre of the slot 6. Thus the flat outer faces 9,10 of the lips 7,8 form a flat abutment surface against which an element to be connected to the extrusion may readily abut. The lips 9,10 also have flat co-aligned inner faces 11,12 which are parallel with the outer faces. These inner faces are designed to receive appropriate clamping means to enable items to be readily clamped to the leg.

Extending between the points on either side of the slot 6 where the lips 7,8 engage the outer wall 2 is a substantially semi-circular web 13. The web is inwardly directed, in that the web is located n the interior of the pipe defined by the wall 2, rather than on the exterior thereof. The inner surface 14 of the web 13 thus defines, together with the lips 7 and 8, a channel 15 which communicates with the slot 6, the channel 15 having a substantially semi-circular base defined by the face 14 of the web 13 and a substantially planar top defined by the surfaces 11 and 12 of the inwardly directed lips 7 and 8.

It has been found that a shoring leg, having the form illustrated with reference to FIGS. 1 and 2 possesses various advantages with regard to the prior art.

One embodiment of a leg as described above is 6% lighter than the prior art leg discussed above for an equal strength.

However, the leg possesses a further advantage over the prior art in that the leg presents eight equi-angularly spaced slots, enabling the leg to be utilised not only with elements which extend orthogonally to each other, but also with elements which can extend at 45° to the orthogonal. This provides a much greater degree of flexibility in designing shoring systems. For example, the use of a leg as described above facilitates the fabrication of an octagonal shape, and facilitates the support of a corner of a horizontal formwork that "overhangs? the shoring leg.

It is to be noted that the exterior envelope of the extrusion of FIGS. 1 and 2 is a circle. This provides an advantage that the profile is relatively easy to carry, and is found to rest more easily on a shoulder than the prior art leg. Also, it is to be appreciated that, because the external profile of the leg is circular, it is possible to utilise, with the leg, a clamp which clamps against the outer periphery of the leg, the clamp thus being positionable at any selected angle. It is, of course, impossible to provide a clamp which engages a substantially square sectioned leg at any selected angle. Such a clamp can only engage the leg at orthogonal angles.

A further advantage of a leg in accordance with the invention is that if the leg is utilised with a jack which incorporates an element which extends up the hollow interior of the leg, the jack will be guided by the inwardly directed webs 13, and there will be eight such webs constraining movement of the jack. Thus the jack will be guided in a more accurate manner and the stability of the jack within the leg will be improved.

Turning now to FIG. 3 a further, somewhat simplified, embodiment of the invention is illustrated. This embodiment is broadly similar to the embodiment of FIG. 1 and like reference numerals are used for like parts. It is to be noted, however, that in this embodiment only four slot formations are provided at equi-angularly spaced positions. This leg, does not possess all the advantages of the leg of FIG. 1 as described above, but nevertheless a leg may still be found to be very useful. It is, however, very important to note that a typical leg of this form which provides the same performance as the leg of the prior art discussed above, will provide a weight-saving of 15%. The leg will also present the advantages of being relatively easy to carry and being able to accept a clamp in the form of a ring surrounding the leg clamping auxiliary items to the leg at any selected angle.

It is to be noted that the weight-saving achieved by the legs of the present invention when compared with the prior art mean that less raw material is utilised in fabricating the legs, making the legs less expensive to manufacture, and also the lightness facilitates transportation of the legs, eases the erection of the shoring utilising the legs and means that a shoring system providing a certain function will have a lesser overall weight.

What is claimed is:

1. A shoring leg, the leg comprising an extrusion of aluminium or the like, the leg presenting a plurality of axially extending slots in its exterior at substantially equi-angularly spaced positions, the leg comprising a wall defining a substantially circular outer periphery and a hollow interior, the wall being interrupted by slot formations at substantially equi-angularly spaced positions, each slot formation comprising a pair of inwardly directed lips defining a slot therebetween, and an inwardly directed web of substantially semi-circular form extending between the points where the lips, on each side of the slot, extend from the said circular wall.

2. A shoring leg according to claim 1 wherein the lips define substantially co-aligned flat outer faces, the faces defining a plane which extends perpendicularly to a radius of the extrusion passing through the centre of the respective slot.

3. An extrusion according to claim 1 wherein the inner faces of the lips define a substantially planar surface which extends perpendicularly to a radius of the extrusion passing through the centre of the slot.

4. A shoring leg according to claim 1 wherein there are eight equi-angularly spaced slots.

5. A shoring leg according to claim 1 wherein there are four equi-angularly spaced slots.

* * * * *